US008864013B2

(12) United States Patent
Franco et al.

(10) Patent No.: US 8,864,013 B2
(45) Date of Patent: Oct. 21, 2014

(54) SUSTAINABLE PACKAGING SYSTEM AND METHOD THEREOF

(75) Inventors: David Louis Franco, Brooklyn, NY (US); Andres Ruiz, Metuchen, NJ (US)

(73) Assignee: Franco Manufacturing Co., Inc., Metuchen, NJ (US)

( * ) Notice: Subject to any disclaimer, the term of this patent is extended or adjusted under 35 U.S.C. 154(b) by 519 days.

(21) Appl. No.: 12/968,901

(22) Filed: Dec. 15, 2010

(65) Prior Publication Data

US 2011/0139861 A1 Jun. 16, 2011

Related U.S. Application Data

(60) Provisional application No. 61/287,084, filed on Dec. 16, 2009.

(51) Int. Cl.

| | |
|---|---|
| ***B65D 5/00*** | (2006.01) |
| ***B65B 11/00*** | (2006.01) |
| ***B65B 11/58*** | (2006.01) |
| ***B65D 5/32*** | (2006.01) |

(52) U.S. Cl.

CPC ..... *B65D 5/327* (2013.01); *B65B 11/58* (2013.01); *B65B 11/004* (2013.01)

USPC ..... 229/103.2; 206/494

(58) Field of Classification Search

CPC ..... B65D 85/182; B65D 75/38; B65D 85/18; B65D 5/545

USPC ..... 229/103.2, 122.23, 122.24, 122.26, 229/164.1, 120.06, 120.19, 120.25, 120.12, 229/120.09; 206/155, 442, 297, 525.1; 220/23.91; 294/154; 223/71

See application file for complete search history.

(56) References Cited

U.S. PATENT DOCUMENTS

| | | | | |
|---|---|---|---|---|
| 2,166,642 | A * | 7/1939 | Rechtschaffen | 223/71 |
| 3,688,948 | A * | 9/1972 | Roda | 223/71 |
| 3,908,823 | A * | 9/1975 | Smith | 206/292 |
| 4,627,223 | A | 12/1986 | Janhonen | |
| 5,004,144 | A * | 4/1991 | Selga | 229/87.19 |

(Continued)

FOREIGN PATENT DOCUMENTS

| | | | | |
|---|---|---|---|---|
| FR | 2636920 | A1 * | 3/1990 | B65D 5/48 |
| JP | 11321245 | | 11/1999 | |
| JP | 2008056318 | | 3/2008 | |

OTHER PUBLICATIONS

International Search Report and Written Opinion from PCT Patent Application No. PCT/US10/060690, dated Jul. 28, 2011, 9 pages.

*Primary Examiner* — Gary Elkins
*Assistant Examiner* — Christopher Demeree
(74) *Attorney, Agent, or Firm* — Maldjian Law Group LLC; John Maldjian

(57) ABSTRACT

A sustainable packing system is provided comprising a first fiberboard having a substantially flat surface for accepting a first item and at least one scored line for facilitating folding of the first fiberboard, the first fiberboard adapted to form a closed wall; and a second fiberboard adapted to be frictionally secured within the closed wall of the first fiberboard, having a substantially flat surface for accepting a second item and at least one scored line for facilitating folding of the second fiberboard to form a closed wall. A packaging method is also provided comprising providing a fiberboard having a substantially flat surface; scoring lines in the fiberboard to facilitate folding; wrapping a first item around the fiberboard; and folding the fiberboard forming a closed wall.

18 Claims, 5 Drawing Sheets

(56) References Cited

U.S. PATENT DOCUMENTS

| | | | | |
|---|---|---|---|---|
| 5,248,034 | A | 9/1993 | Janhonen | |
| 5,718,338 | A | 2/1998 | Yucknut et al. | |
| 5,833,131 | A * | 11/1998 | Levi | 229/103.2 |
| 5,947,366 | A | 9/1999 | Feldmann et al. | |
| D453,057 | S * | 1/2002 | Sewell | D34/38 |
| 7,644,858 | B2 * | 1/2010 | Glaser et al. | 229/117.16 |
| 2004/0026488 | A1 * | 2/2004 | Beach | 229/87.19 |
| 2005/0023168 | A1 | 2/2005 | Marnocha | |
| 2007/0228127 | A1 * | 10/2007 | Gardner | 229/122.23 |

* cited by examiner

100

100

100

SUSTAINABLE PACKAGING SYSTEM AND METHOD THEREOF

CROSS-REFERENCE TO RELATED APPLICATIONS

This Application claims priority to, and the benefit of, pending U.S. Provisional Application Ser. No. 61/287,084, filed Dec. 16, 2009, entitled "Sustainable Packaging System and Method Thereof," the disclosure of which is incorporated herein by reference in its entirety.

BACKGROUND

1. Field of the Invention

Embodiments of the present invention generally relate to a sustainable packaging system and method thereof. More specifically, embodiments of the present invention relate to a sustainable packing system and method thereof for packaging textiles.

2. Description of Related Art

Due to mounting global concerns about the state of the environment, it has become necessary for producers to adopt eco-friendly methods of operation. One area in which producers are looking to reduce their "carbon footprint" has been the reduction of unnecessary product packaging, especially plastic packaging. Plastic and similar non-sustainable substances are often not biodegradable, and therefore are pollutants to the environment. Several billion tons of plastic are buried in landfills each year. This creates a large waste mass that impedes the flow of ground water and obstructs the movement of roots, thereby negatively affecting the soils biological balance and organic processes. A need exists for a packaging system eliminates or reduces product packaging and especially plastic waste.

Current non-plastic systems and methods of packaging include using large boxes and similar systems and methods to deliver products to the retailer and to store the products at point of sale retailer outlets. When an item must be displayed to a consumer on the shelves of a retail outlet, however, placing the products in boxes is often a poor method of merchandising. Therefore, a need exists for a non-plastic, sustainable packaging system and method thereof that enables the transport and display of the product to the consumer.

SUMMARY

In accordance with one embodiment of the present invention, there is provided a sustainable packing system comprising: a first fiberboard having a substantially flat surface for accepting a first item and at least one scored line for facilitating folding of the first fiberboard, the first fiberboard adapted to form a closed wall; and a second fiberboard adapted to be frictionally secured within the closed wall of the first fiberboard, having a substantially flat surface for accepting a second item and at least one scored line for facilitating folding of the second fiberboard to form a closed wall.

In accordance with another embodiment of the present invention, there is provided a sustainable packing system comprising: a first fiberboard having a substantially flat surface for accepting an item and at least one scored line for facilitating folding of the first fiberboard, the first fiberboard adapted to form a closed wall; a second fiberboard secured within the closed wall of the first fiberboard, the second fiberboard having a substantially flat surface for accepting an item and at least one scored line for facilitating folding of the second fiberboard to form a closed wall; and a securing band for adapted to wrap around the first fiberboard and secure the first fiberboard in a folded position and secure the second fiberboard within the closed wall of the first fiberboard.

In accordance with another embodiment of the present invention, there is provided a packaging method comprising: providing a fiberboard having a substantially flat surface; scoring lines in the fiberboard to facilitate folding; wrapping a first item around the fiberboard; and folding the fiberboard forming a closed wall.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
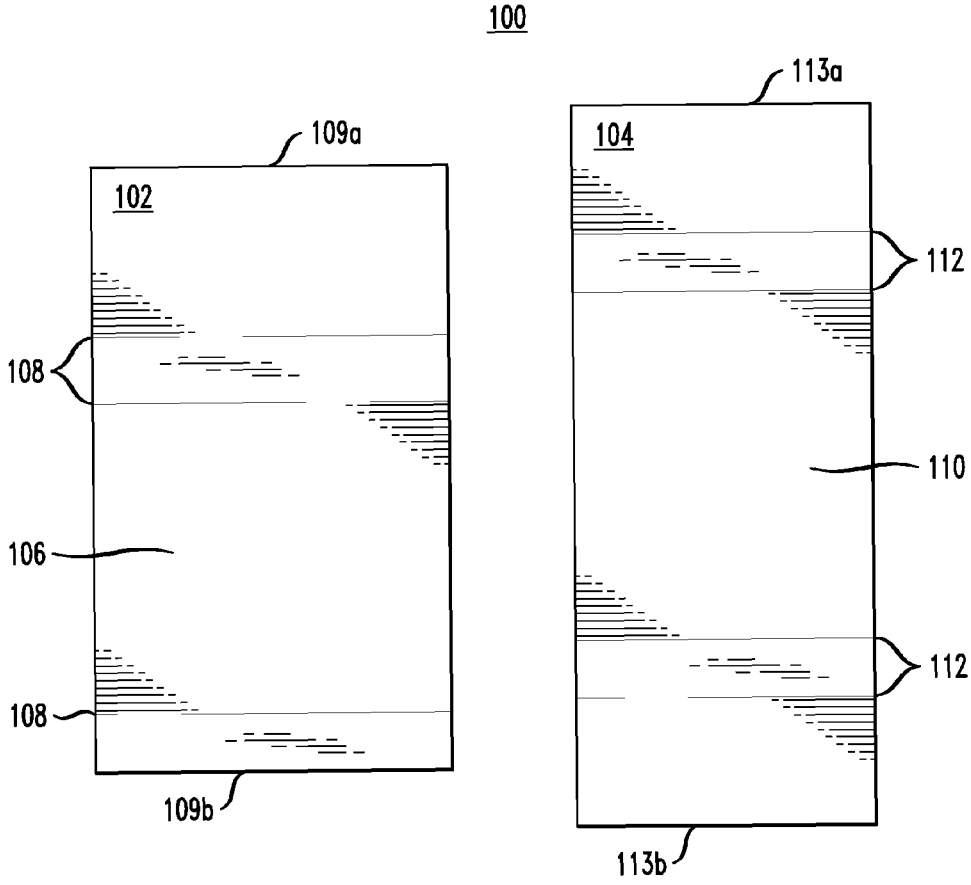
FIG. 1 depicts a top view of a packaging system in accordance with an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

DETAILED DESCRIPTION

Embodiments of the present invention generally relate to a sustainable packaging system and method thereof. As shown in FIGS. 1-14, many embodiments of the present invention include packaging for textiles. However, it should be understood non-textile sustainable packaging and method thereof are contemplated by and within the scope of the present invention. As used herein, the term "textiles" includes, without limitation, all fabrics containing natural or synthetic fibers, and all blends made from these fibers. As shown in the exemplary embodiments depicted in the figures, embodiments of the present invention comprise packaging materials manufactured using corrugated fiberboard. Alternative materials, having similar properties, are also contemplated by embodiments of the present invention. Such exemplary materials may include: a cellulose product, such as kraft paper, high sized board, wood-pulp paper, manila paper, bleached paperboard, or any combination thereof; polymer materials, particularly biodegradable plastics (i.e., bioplastics or petroleum-based plastics); or the like. As used herein, the term "fiberboard" includes, without limitation, any cellulose-based material consisting of a fluted corrugated sheet and one or two flat linerboards.

The following detailed description generally describes the exemplary embodiments of the present invention, as depicted in FIGS. 1-14, and should not be considered limiting to other equally effective embodiments, as understood to those of ordinary skill in the art.

FIG. 1 is a top view of a packaging system 100 in accordance with an embodiment of the present invention. Generally, the packaging system 100 may comprise a first fiberboard 102 and a second fiberboard 104 for packaging items. Although two fiberboards 102, 104 are depicted in FIG. 1, any number of fiberboards is contemplated in embodiments of the present invention. In accordance with embodiments of the present invention the item or items to be packaged by the packaging system 100 may comprise, for example, a textile such as a flat bed sheet, a fitted bed sheet, and a pillowcase, window panel, a drape, and the like.

The first fiberboard 102 may comprise a surface 106 for accepting a first item (not shown), at least one fold line 108 for facilitating folding of the first fiberboard 102, and at least two ends 109*a*, 109*b*. The surface 106 may comprise the entire surface area of the first fiberboard 102 or any portion of the fiberboard. The surface 106 may generally be substantially flat, but all levels of concavity or convexity are contemplated in embodiments of the present invention. Although three fold lines 108 are depicted on the first fiberboard 102 in FIG. 1, any number of fold lines is contemplated in embodiments of the present invention. In accordance with embodiments of the present invention, the fold lines 108 may generally partition the first fiberboard 102 into at least two sections.

The first fiberboard 102 may be adapted to form a closed wall. The closed wall may be formed by folding the first fiberboard 102 about the fold lines 108 and each partitioned section may be folded inwardly toward an axis so that each of the ends 109*a*, 109*b* are substantially juxtaposed each other. The second fiberboard 104 may be adapted to be frictionally secured within the closed wall of the first fiberboard 102. The first fiberboard 102 may be adapted to allow the first item (not shown) to be wrapped around the first fiberboard 102. The first item (not shown) may comprise any item adapted to wrap around the surface 106 of the first fiberboard 102. For example, in one embodiment of the present invention, the first item (not shown) may comprise a flat bed sheet. In alternative embodiments of the present invention, the flat sheet may be either wrapped around the first fiberboard 102 or the first fiberboard 102 may be placed inside the flat sheet or an aperture in the flat sheet.

The second fiberboard 104 may comprise a surface 110 for accepting a second item (not shown), at least one fold line 112 for facilitating folding of the second fiberboard 104, and at least two ends 113*a*, 113*b*. The surface 110 may comprise the entire surface area of the second fiberboard 104 or any portion of the fiberboard. The surface 110 may generally be substantially flat, but all levels of concavity or convexity are contemplated in embodiments of the present invention. Although four fold lines 112 are depicted on the second fiberboard 104 in FIG. 1, any number of fold lines is contemplated in embodiments of the present invention. In accordance with embodiments of the present invention, the fold lines 112 may generally partition the second fiberboard 104 into at least three sections.

The second fiberboard 104 may be adapted to form a closed wall. The closed wall may be formed by folding the second fiberboard 104 about the fold lines 112 and each partitioned section may be folded inwardly so each of the ends 113*a*, 1113*b* are substantially juxtaposed each other. The second fiberboard 104 may be adapted to allow the second item (not shown) to be wrapped around the second fiberboard 104. The second item (not shown) may comprise any item adapted to wrap around the surface 110 of the second fiberboard 104. For example, in one embodiment of the present invention, the second item (not shown) may comprise a pillowcase. In alternative embodiments of the present invention, the pillowcase may be either wrapped around the second fiberboard 104 or the second fiberboard 104 may be placed inside the pillowcase or an aperture in the pillowcase. The second fiberboard 104 may also be adapted to accept a third item within the closed wall of the second fiberboard 104. The third item (not shown) may comprise any item adapted to fit within the closed wall of the second fiberboard. For example, in one embodiment of the present invention, the third item (not shown) may comprise a fitted sheet.

Although the first fiberboard 102 and the second fiberboard 104 are depicted in a rectangular shape, fiberboards of any shape, or any combination of shapes are contemplated in embodiments of the present invention. For example, in accordance with embodiments of the present invention, the fiberboards may comprise rectangular, circular, triangular, or square shapes. In accordance with embodiments of the present invention, the first fiberboard 102 and the second fiberboard 104 may comprise the same shape or may comprise different shapes.

Because the first fiberboard 102 and second fiberboard 104 may generally be cut from a larger piece of fiberboard in embodiments of the present invention, the size of the first fiberboard 102 and second fiberboard 104 may be respectively determined by the size of the product or item to be packaged, as further described herein. The first fiberboard 102 and the second fiberboard 104 may be cut into any size. For example, the size of the first fiberboard 102 may be 22.75"×10.75," and the size of the second fiberboard 104 may be 24.275"×8.825." All ranges of sizes of, and ratios between, the first fiberboard and the second fiberboard, which are capable of enabling embodiments of the present invention are contemplated and within the scope of the present invention.

In accordance with embodiments of the present invention, the plurality of fold lines 108, 112 may be made at predetermined measurements along the first fiberboard 102 and the second fiberboard 104, to facilitate proper bending or folding of the packaging. The fold lines 108, 112 may be made, for example, by scoring the fiberboard. In accordance with an exemplary embodiment of the present invention, fold lines may be scored on the first fiberboard 102 and second fiberboard 104 at any predetermined measurements. For example, the first fiberboard 102 may comprise three fold lines 108 scored at measurements of 9.125," 11.375," and 20.5," and the second fiberboard may comprise four fold lines scored at measurements of 5.125," 6.875," 17.4," and 19.15."

Figure 2:
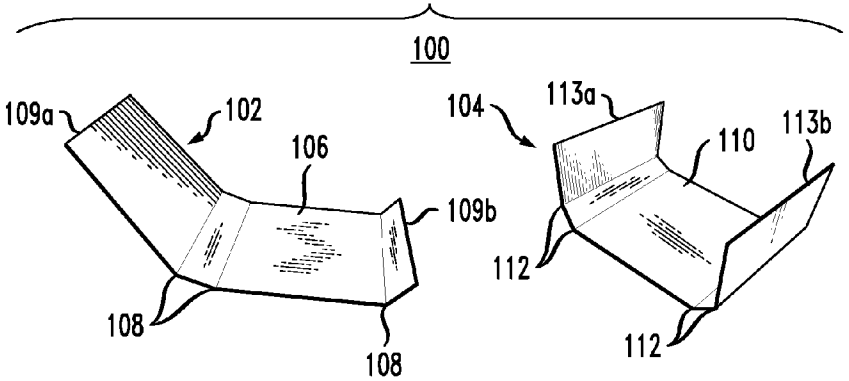
FIG. 2 depicts a perspective view of a first fiberboard and a second fiberboard used for packaging in accordance with an embodiment of the present invention.

FIG. 2 depicts a perspective view of a first fiberboard 102 and a second fiberboard 104 used for packaging in accordance with an embodiment of the present invention. The first fiberboard 102 and the second fiberboard 104 depicted in FIG. 2 may be similar to those described in FIG. 1, and comprise similar flat surfaces 106, 110; fold lines 108, 112; and ends 109*a*, 109*b*, 113*a*, 113*b* to those described in FIG. 1. The fold lines 108, 112, may generally partition the fiberboards 102, 104, into a plurality of sections in accordance with embodiments of the present invention. At least one of the plurality of sections may be folded inwardly, allowing the first fiberboard 102 to form a closed wall for accepting the second fiberboard 104, and the second fiberboard 104 to form a closed wall for accepting an item (not shown).

Figure 3:
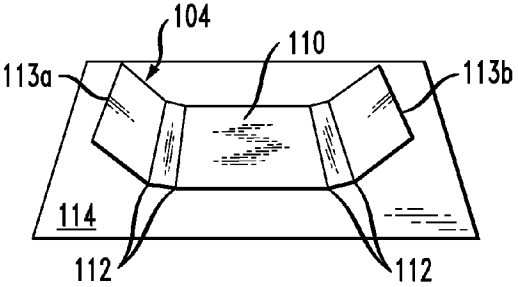
FIG. 3 depicts a perspective view of an item and a fiberboard used for packaging in accordance with an embodiment of the present invention.

FIG. 3 depicts a perspective view of an item 114 and a fiberboard 104 used for packaging in accordance with an embodiment of the present invention. The fiberboard 104 may be similar to the second fiberboard 104 described in FIGS. 1 and 2, and may comprise a similar surface 110, fold lines 112, and ends 113*a*, 113*b* to those described in FIGS. 1 and 2. The item 114 may be any item adapted to fold around the fiberboard 104. For example, the item may comprise a flat bed sheet in accordance with an embodiment of the present invention. The fiberboard 104 may generally be folded about the fold lines 112. In certain embodiments, the fiberboard 104 may subsequently be folded over an additional item (see FIG. 5) about the fold lines 112, substantially enclosing the third item within a wall formed by the fiberboard 104. In operation, the fiberboard 104 may be placed on the item 114 or, alternatively, the item 114 may be placed on the fiberboard 104. The item 114 may be wrapped around the fiberboard 104 for purposes of packaging.

Figure 4:
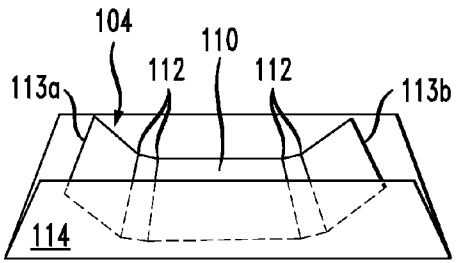
FIG. 4 depicts a perspective view of an item partially folded around a fiberboard used for packaging in accordance with an embodiment of the present invention.

FIG. 4 depicts a perspective view of an item 114 partially folded around a fiberboard 104 used for packaging in accordance with an embodiment of the present invention. The fiberboard 104 may be similar to the fiberboard 104 described in FIG. 3, and may comprise a similar surface 110, fold lines 112, and ends 113*a*, 113*b*. The item 114 may be similar to the item 114 described in FIG. 3. The item 114 may be folded around the first fiberboard 104 in accordance with one embodiment of the present invention. The item 114 may be folded around the first fiberboard 104 substantially covering the fiberboard 104. The item 114 may also completely cover the fiberboard 104. In accordance with an embodiment of the present invention, the item 114 may comprise a textile. For example, in one embodiment of the present invention, the item 114 may comprise a flat sheet. As depicted in FIG. 4, the item 114 is folded over one-half of the fiberboard 104. The unfolded portion of the item 114 may then be folded over the fiberboard 104, substantially covering the fiberboard 104.

Figure 5:
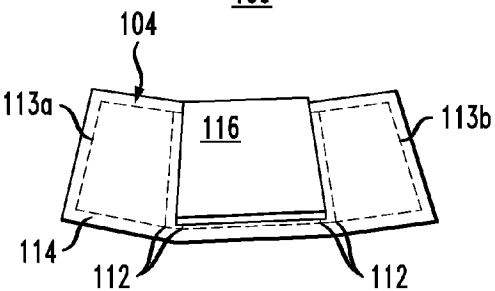
FIG. 5 depicts a perspective view of a first item folded around a fiberboard used for packaging in accordance with an embodiment of the present invention and a second item folded and placed on top of the fiberboard in accordance with an embodiment of the present invention.

FIG. 5 depicts a perspective view of a first item 114 folded around a fiberboard 104 used for packaging in accordance with an embodiment of the present invention and an additional item 116 placed on top of the fiberboard 104 in accordance with an embodiment of the present invention. The fiberboard 104 may be similar to the fiberboard 104 described in FIGS. 3 and 4, and may comprise a similar surface 110, fold lines 112, and ends 113*a*, 113*b*. The item 114 may be similar to the item 114 described in FIGS. 3 and 4. The fiberboard 104 may be adapted to accept an additional item 116 within the closed wall of the fiberboard 104. The additional item 116 may comprise any item adapted to fit on the surface of the fiberboard 104, wherein the fiberboard 104 is wrapped with the item 114. In accordance with embodiments of the present invention, the fiberboard 104 wrapped with the item 114 may be wrapped around the additional item 116 in accordance with embodiments of the present invention. The additional item 116 may generally comprise a textile. For example, the additional item 116 may comprise a fitted sheet. In alternative embodiments of the present invention, the fiberboard 104 may be adapted for accepting the second item 116 outside the closed wall of the fiberboard 104 and outside the wall of an additional fiberboard (not shown) but between the walls formed the fiberboard 104 and the additional fiberboard (not shown).

Figure 6:
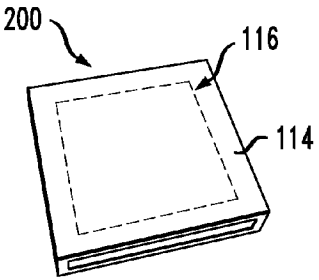
FIG. 6 depicts a perspective view of a first item folded around a fiberboard used for packaging in accordance with an embodiment of the present invention and a second item folded and secured inside the closed wall of the fiberboard forming an interior package in accordance with an embodiment of the present invention.

FIG. 6 depicts a perspective view of a first item 114 folded around a fiberboard used for packaging in accordance with an embodiment of the present invention and a second item 116 folded and secured inside the closed wall of the fiberboard forming an interior package 200 in accordance with an embodiment of the present invention. The interior package 200 may be adapted to fit inside the closed wall of an additional fiberboard (not shown).

Figure 7:
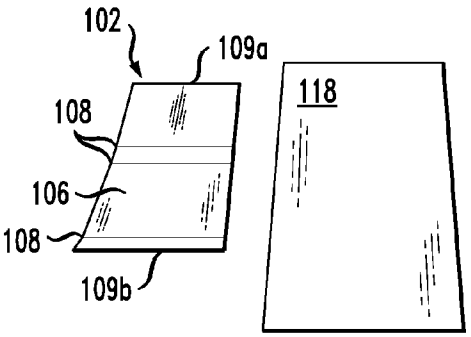
FIG. 7 depicts a perspective view of an item and a fiberboard used for packaging in accordance with an embodiment of the present invention.

FIG. 7 depicts a perspective view of an item 118 and a fiberboard 102 used for packaging in accordance with an embodiment of the present invention. The item 118 may be folded around a fiberboard 102 used for packaging in accordance with an embodiment of the present invention. The fiberboard 102 may be similar to the first fiberboard 102 described in FIGS. 1 and 2, and may comprise a similar surface 106, fold lines 108, and ends 109*a*, 109*b* as described in FIGS. 1 and 2. The item 118 may comprise any item adapted to fold around the fiberboard 102. The item 118 may generally comprise a textile. For example, the item may comprise a pillowcase in accordance with an embodiment of the present invention. The fiberboard 102 may generally be folded about the fold lines 108. In certain embodiments, the fiberboard 102 may subsequently be folded over an interior package (see FIG. 10) about the fold lines 108, substantially enclosing the interior package within a wall formed by the fiberboard 102. In operation, the fiberboard 102 may be placed on the item 118 or, alternatively, the item 118 may be placed on the fiberboard 102. The item 118 may be wrapped around the fiberboard 102 for purposes of packaging.

The fiberboard 102 may also be adapted to accept an additional item (not shown). The fiberboard 102 may be adapted to accept the additional item (not shown) item within the closed wall of the fiberboard 102. The fiberboard 102 and a second fiberboard (not shown) may be adapted for accepting the second item (not shown) between the closed wall of the fiberboard 102 and the closed wall of the second fiberboard (not shown).

Although in some embodiments of the present invention the items have been described herein as a flat sheet, a pillowcase, and a fitted sheet, it is contemplated by the present invention that these types of textile are interchangeable and any other type of textile could be substituted for these examples.

Figure 8:
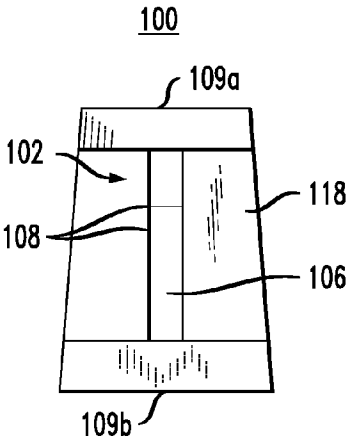
FIG. 8 depicts a perspective view of an item partially folded around a fiberboard used for packaging in accordance with an embodiment of the present invention.

FIG. 8 depicts a perspective view of an item 118 partially folded around a fiberboard 102 used for packaging in accordance with an embodiment of the present invention. The fiberboard 102 may be similar to the first fiberboard 102 described in FIG. 7, and may comprise a similar surface 106, fold lines 108, and ends 109*a*, 109*b* as described in FIGS. 1 and 2. The item 118 may be similar to the item 118 described in FIG. 7. In accordance with embodiments of the present invention, the item 118 may be wrapped around any portion of the fiberboard 102. For example, the item 118 may be wrapped around a portion of the fiberboard, or over the entire surface 102. The additional item 116 may comprise, for example, a pillowcase.

Figure 9:
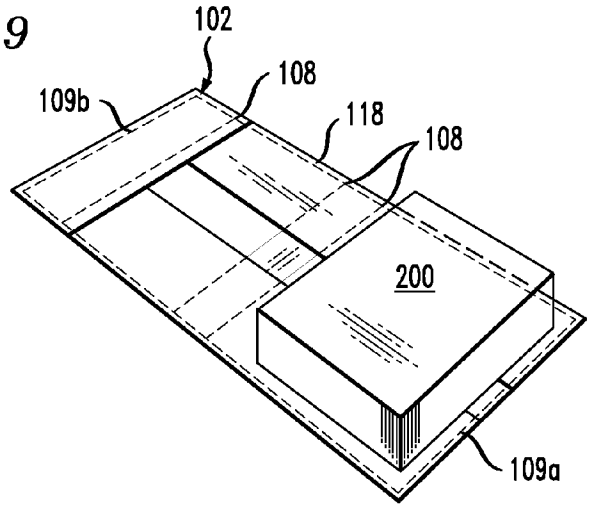
FIG. 9 depicts a perspective view of an item folded around a fiberboard used for packaging in accordance with an embodiment of the present invention and an interior package placed on top of the fiberboard in accordance with an embodiment of the present invention.

FIG. 9 depicts a perspective view of an item 118 folded around a fiberboard 102 used for packaging in accordance with an embodiment of the present invention and an interior package 200 placed on top of the fiberboard in accordance with an embodiment of the present invention. The fiberboard 102 may be similar to the first fiberboard 102 described in FIG. 8, and may comprise a similar surface 106, fold lines 108, and ends 109*a*, 109*b* as described in FIG. 8. The item 118 may be similar to the item 118 described in FIG. 8. The interior package 200 may be similar to the interior package 200 described in FIG. 6. In accordance with embodiments of the present invention, the item 118 item may be wrapped around the first fiberboard 102. The interior package 200 may be placed on the first fiberboard 102 wrapped in the item 118 in preparation for packaging. The first fiberboard 102 wrapped in the item 118 may be placed on the interior package 200 in preparation for packaging.

Figure 10:
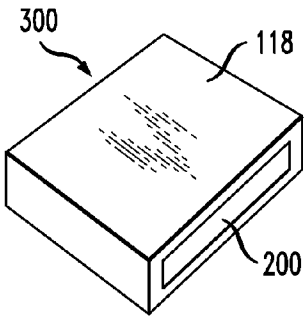
FIG. 10 depicts a perspective view of an item folded around a fiberboard used for packaging in accordance with an embodiment of the present invention and an interior package secured inside the closed wall of the fiberboard forming an exterior package in accordance with an embodiment of the present invention.

FIG. 10 depicts a perspective view of an item 118 folded around a fiberboard (not shown) used for packaging in accordance with an embodiment of the present invention and an interior package 200 secured inside the closed wall of the fiberboard (not shown) forming an exterior package 300 in accordance with an embodiment of the present invention. The fiberboard (not shown) may be similar to the first fiberboard 102 described in FIG. 9, and may comprise a similar surface 106, fold lines 108, and ends 109*a*, 109*b*. The item 118 may be similar to the item 118 described in FIG. 9. The interior package 200 may be similar to the interior package 200 described in FIG. 6. In accordance with embodiments of the present invention, the item 118 item may be wrapped around the first fiberboard (not shown). The first fiberboard (not shown) wrapped in the item 118 may then be wrapped around the interior package 200 to form an exterior package 300. In accordance with embodiments of the present invention, the exterior package 300 may comprise the combination of the first fiberboard (not shown) wrapped in the item 118, wrapped around the interior package 200.

For example, in accordance with embodiments of the present invention, a flat bed sheet 114 may be wrapped around a fiberboard 104 (see FIGS. 3-4); a fitted bed sheet 116 may be folded into a square shape and placed on top of the fiberboard 102 wrapped with the flat bed sheet 114 (See FIG. 5); the fiberboard 104 wrapped with the flat bed sheet 114 may be folded to form a closed wall around the fitted bed sheet 116 to form an interior package 200 (see FIG. 6); a pillowcase 118 may be wrapped around a fiberboard 102 (see FIGS. 7-8); the fiberboard 102 wrapped in the pillowcase 118 may be folded to form a closed wall around the interior package 200, forming an exterior package 300 (see FIGS. 9-10). Although specific textiles are listed in this example for purposes for illustration, any textile, combination of textiles, or any material capable of being packaged in any portion of the exterior package 300 are contemplated in embodiments of the present invention. For example, alternatively, a window drape may be used.

Figure 11:
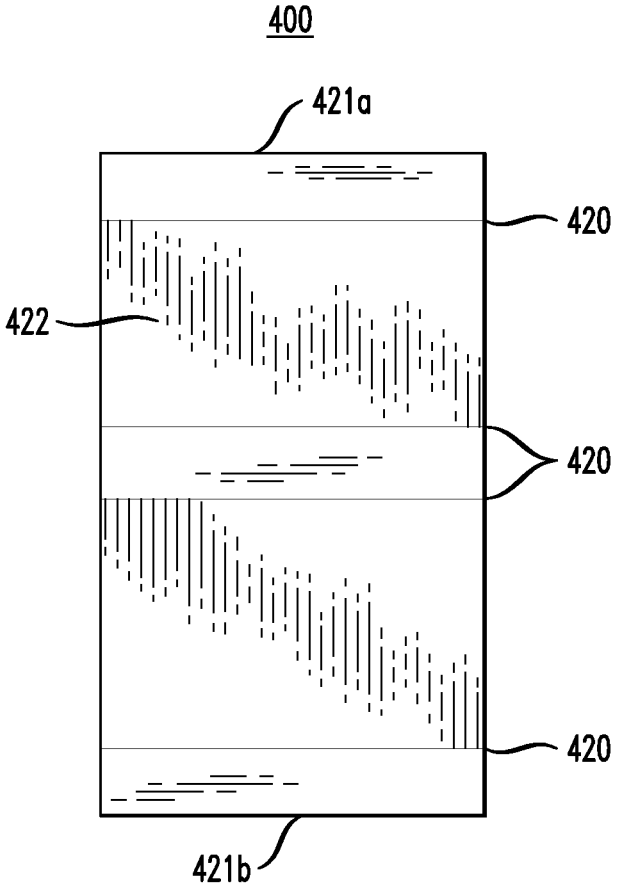
FIG. 11 depicts a perspective view of a securing band adapted for securing packaging in accordance with an embodiment of the present invention.

FIG. 11 depicts a perspective view of a securing band 400 adapted for securing packaging in accordance with an embodiment of the present invention, e.g., the packaging system 100 of FIGS. 1-10. The securing band 400 may generally comprise a surface 422, fold lines 420, and ends 421*a*, 421*b* similar to those described in FIG. 1 with respect to the fiber board 102. In accordance with embodiments of the present invention, the securing band 400 may be adapted to enclose an exterior package (not shown) similar to the exterior package 300 described in FIG. 10. The securing band 400 may comprise any material or structure adapted to secure the exterior package 300 as described in FIG. 10. For example, the securing band 400 may comprise a belly band, a fiberboard, a ribbon, an adhesive, string, tiebacks, other retention mechanism, combinations thereof, or the like. The securing band 40 may generally be adapted to wrap around a first fiberboard (not shown) securing the first fiberboard in a folded position and securing the second fiberboard (not shown) within the closed wall of the first fiberboard.

Figure 12:
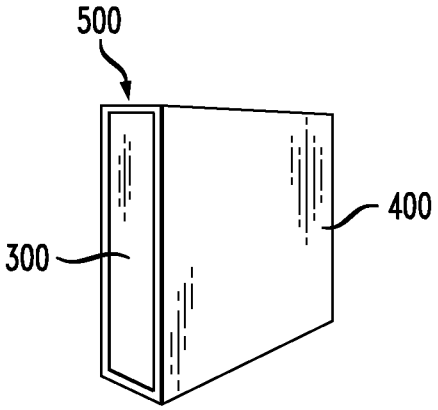
FIG. 12 depicts a perspective view of an exterior package secured within a securing band forming a sustainable packaging system in accordance with an embodiment of the present invention.

FIG. 12 depicts a perspective view of an exterior package 300 secured within a securing band 400 forming a sustainable packaging system 500 in accordance with an embodiment of the present invention. In accordance with embodiments of the present invention, the sustainable packaging system 500 may comprise a securing band 400 and an exterior package 300 similar to the exterior package 300 described in FIG. 10. The sustainable packaging system 500 may form any shape, creating a self-contained, bag-less sustainable packaging system 500 in accordance with any embodiment of the present invention.

The sustainable packaging system 500, is shown in assembled form, in accordance with one embodiment of the present invention. In accordance with one embodiment of the present invention, a first fiberboard (see FIG. 1) may be frictionally fit to a second fiberboard (see FIG. 1), allowing both fiberboards to retain their shape as a single exterior package 300, and to allow the product to be shipped without additional packaging material, especially plastic packaging. In accordance with other embodiments of the present invention, a securing band 400 may optionally be wrapped around the exterior package 300 to assist in retaining the shape.

Figure 13:
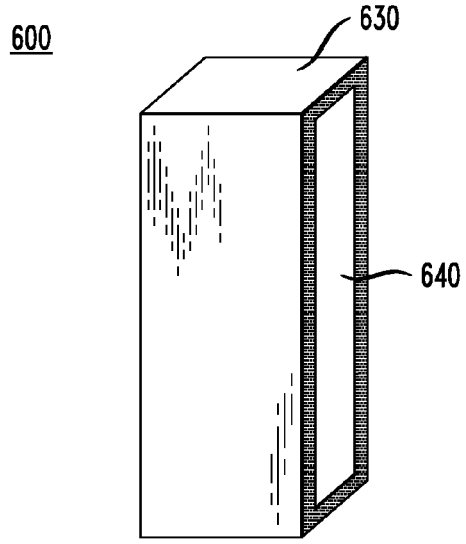
FIG. 13 depicts a perspective view of alternative embodiment of a sustainable packaging system.

FIG. 13 depicts a perspective view of embodiment of an alternative sustainable packaging system 600. In an alternative embodiment of the present invention, one fiberboard (not shown) is wrapped around an item (not shown) to form an alternative interior package 640. The item (not shown) may comprise any item adapted to wrap around a fiberboard. The item may be, for example, textile such as at least one drape panel. In accordance with an alternative embodiment of the present invention, a fiberboard (not shown) is wrapped with an item (not shown) and then wrapped around a second item (not shown). The second item may be, for example, a second drape panel. The alternative interior package 640 may generally be secured and reinforced with an alternative securing band 630. The alternative interior package 640 may be similar to any interior or exterior package 200, 300 described in the figures above. The alternative securing band 630 may be similar to the securing band 400 described in FIG. 11.

Figure 14:
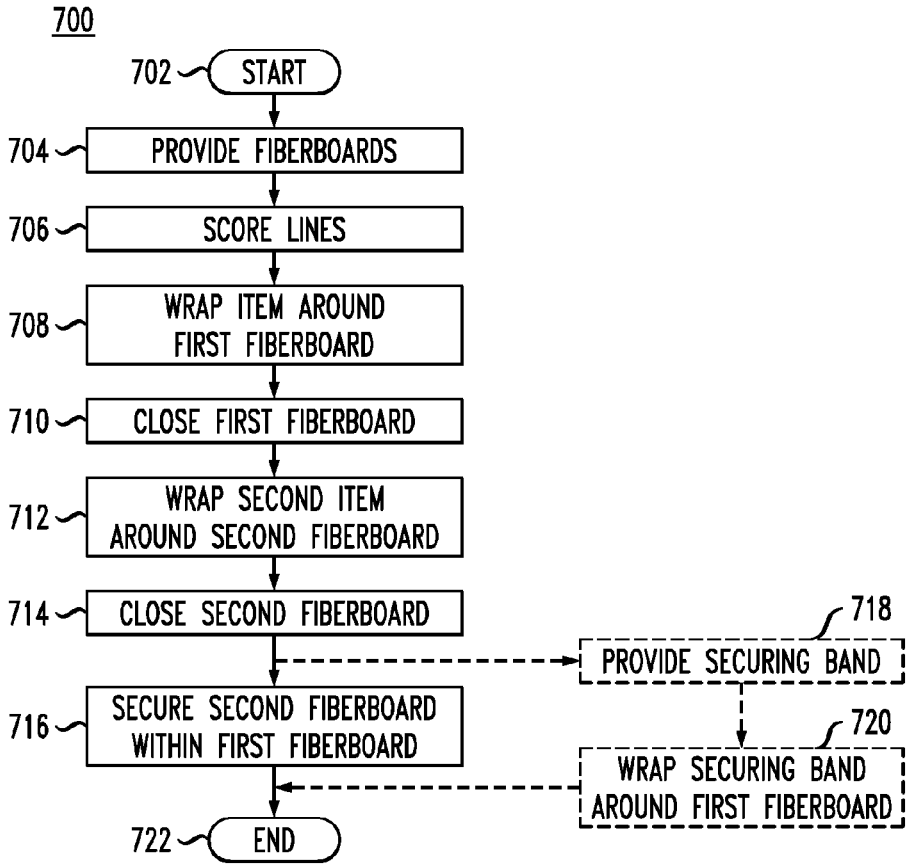
FIG. 14 is a flow chart illustrating a method in accordance with embodiments of the present invention.

FIG. 14 is a flow diagram depicting a method of making a sustainable packaging 700. The method may begin at step 702. At step 704, at least one fiberboard comprising a surface may be provided. In accordance with some embodiments of the present invention, the surface may comprise any level of concavity or convexity adapted to accept an item. For example, the at least one fiberboard may comprise a substantially flat surface. At step 706, fold lines may be scored in the fiberboard to facilitate folding. In accordance with embodiments of the present invention, the fold lines may be scored at predetermined intervals adapted to accept textiles. For example, in embodiments of the present invention, the fold lines may be scored to accept flat sheets, fitted sheets, pillowcases, comforters, mattress pads, and the like. In alternative embodiments of the present invention, the fold lines may be scored at predetermined intervals adapted to accept non-textiles. At step 708, a first item may be wrapped around the fiberboard. In accordance with embodiments of the present invention, the first item may comprise any textile. For example, in embodiments of the present invention, the first item may comprise, a flat bed sheet. At step 710, the fiberboard may be folded about the fold lines forming a closed wall. In accordance with embodiments of the present invention, the closed wall may form any shape. For example, the closed wall may comprise a square shape. In accordance with embodiments of the present invention, the method may end after step 710.

In accordance with alternative embodiments of the present invention, the method may include adding a second fiberboard beginning at step 712. At step 712, a second fiberboard is provided adapted to be frictionally secured within the closed wall of the first fiberboard, having a substantially flat surface; lines may be scored in the second fiberboard to facilitate folding; and a second item may be wrapped around the second fiberboard. In accordance with embodiments of the present invention, the second fiberboard may be adapted to accept a textile. For example, the second fiberboard may be adapted to accept a pillowcase. At step 714, second fiberboard may be folded forming a closed wall around a third item. In accordance with embodiments of the present invention, the closed wall may comprise any shape. For example, the closed wall may comprise a square. In accordance with embodiments of the present invention, the third item may comprise a textile. For example, the third item may comprise a fitted bed sheet. At optional step 718, a securing band may be provided. In accordance with embodiments of the present invention, the securing band may comprise any band adapted to securing any packaging system contemplated in any embodiment of the present invention. For example, the securing band may comprise a bellyband adapted to secure a second fiberboard secured within the closed wall of a first fiberboard. At step 716, the second fiberboard may be secured within the closed wall of the first fiberboard. In accordance with embodiments of the present invention, the closed wall may comprise any shape. For example, the closed wall may comprise a square. At optional step 720, a securing band may be wrapped around all fiberboards, securing the fiberboards closed with a band. In accordance with some embodiments of the present invention, the securing band may comprise, paper, adhesive, ribbon, fabric, or any material capable of securing a second fiberboard within a closed wall of a first fiberboard, or the like. The method ends at step 722. In accordance with some embodiments of the present invention, the method ends with the completion of a sustainable packaging system that may minimize the use of plastic materials. All elements of the method 700 may be similar to those described in FIGS. 1-14.

While the foregoing is directed to embodiments of the present invention, other and further embodiments of the invention may be devised without departing from the basic scope thereof. In particular, it should be appreciated that any element of any embodiments disclosed herein may be combined with any other elements from any other embodiments disclosed herein, in accordance with yet further embodiments of the present invention.

What is claimed is:

1. A sustainable packing system comprising:

first and second bedding material;

a first fiberboard having a substantially flat surface and at least one scored line for facilitating folding of the first fiberboard, the first fiberboard forming a closed wall when folded along the at least one scored line, wherein the first bedding material substantially covers, and is removably wrapped around, the first fiberboard; and a second fiberboard frictionally secured within the closed wall of the first fiberboard, the second fiberboard having a substantially flat surface and at least one scored line for facilitating folding of the second fiberboard to form a closed wall, wherein the second bedding material substantially covers, and is removably wrapped around, the second fiberboard;

wherein the second fiberboard and second bedding material form an interior package and the first fiberboard and first bedding material enclose the interior package on at least four sides of the interior package.

2. The sustainable packaging system of claim 1, wherein the second fiberboard is adapted to accept a third bedding material.

3. The sustainable packaging system of claim 2, wherein the second fiberboard accepts the third bedding material within the closed wall of the second fiberboard.

4. The sustainable packaging system of claim 2, wherein the first fiberboard and the second fiberboard accept the third bedding material between the closed wall of the first fiberboard and the closed wall of the second fiberboard.

5. The sustainable packaging system of claim 1, wherein the first fiberboard and the second fiberboard are substantially rectangular in shape.

6. The sustainable packaging system of claim 1, wherein the first fiberboard comprises three parallel scored lines and the second fiberboard comprises four parallel scored lines.

7. The sustainable packaging system of claim 1, wherein the first fiberboard, the first bedding material, and the interior package form an exterior package, the sustainable packaging system further comprising a securing band wrapped around the exterior package to maintain the exterior package in a square shape.

8. The sustainable packaging system of claim 7, further comprising an additional bedding material enclosed within the second fiberboard and the second bedding material such that the interior package includes the additional bedding material.

9. The sustainable packaging system of claim 1, wherein the first fiberboard, the first item, and the interior package form an exterior package, the exterior package having a square shape.

10. A sustainable packing system comprising:

first and second bedding material;

a first fiberboard having a substantially flat surface and at least one scored line for facilitating folding of the first fiberboard, the first fiberboard forming a closed wall when folded along said at least one scored line, wherein the first bedding material substantially covers, and is removably wrapped around, the first fiberboard;

a second fiberboard secured within the closed wall of the first fiberboard, the second fiberboard having a substantially flat surface and at least one scored line for facilitating folding of the second fiberboard to form a closed wall, wherein the second bedding material substantially covers, and is removably wrapped around, the second fiberboard, and wherein the second fiberboard and second bedding material form an interior package, and the first fiberboard and first bedding material enclose the interior package; and an outer securing band wrapped around the first fiberboard and the first bedding material to secure the first fiberboard and the first bedding material in a folded position around the interior package.

11. The sustainable packaging system of claim 10, wherein the outer securing band comprises at least one of a bellyband or a ribbon.

12. The sustainable packaging system of claim 10, wherein the second fiberboard accepts a third bedding material.

13. The sustainable packaging system of claim 12, wherein the second fiberboard accepts the third bedding material within the second closed wall.

14. The sustainable packaging system of claim 12, wherein the first fiberboard and the second fiberboard accepts the third bedding material between the closed wall of the first fiberboard and the closed wall of the second fiberboard.

15. The sustainable packaging system of claim 10, wherein the first fiberboard comprises three parallel scored lines spaced apart from each other to enable the first fiberboard to be folded into a square shape about the second fiberboard and the second bedding material.

16. The sustainable packaging system of claim 10, wherein the second fiberboard comprises four parallel scored lines spaced apart from each other to enable the second fiberboard and the second bedding material to be folded into a square shape.

17. The sustainable packaging system of claim 10, wherein the first fiberboard, and first bedding material are configured to enclose the interior package on at least four sides.

18. The sustainable packaging system of claim 10, wherein the first fiberboard, the first bedding material, and the interior package form an exterior package, the exterior package and the outer securing band having a square shape.

* * * * *